US007967084B2

(12) United States Patent
Murray

(10) Patent No.: US 7,967,084 B2
(45) Date of Patent: Jun. 28, 2011

(54) EXTERNAL WATER DELIVERY SYSTEM FOR ROCK DRILLS

(75) Inventor: William James Murray, Malanshof (ZA)

(73) Assignee: Longyear TM, Inc., South Jordan, UT (US)

( * ) Notice: Subject to any disclaimer, the term of this patent is extended or adjusted under 35 U.S.C. 154(b) by 226 days.

(21) Appl. No.: 12/356,737

(22) Filed: Jan. 21, 2009

(65) Prior Publication Data

US 2010/0059281 A1 Mar. 11, 2010

Related U.S. Application Data

(60) Provisional application No. 61/094,579, filed on Sep. 5, 2008.

(51) Int. Cl.
*E21B 21/00* (2006.01)
*B25D 17/16* (2006.01)

(52) U.S. Cl. ..... 175/214; 173/197

(58) Field of Classification Search ..... 175/122, 175/207, 197, 214; 137/561 R; 173/105, 173/197; 285/121.6, 121.3, 272, 98, 190; 405/138; 299/81.1; 37/905
See application file for complete search history.

(56) References Cited

U.S. PATENT DOCUMENTS

| | | | | |
|---|---|---|---|---|
| 2,937,029 | A * | 5/1960 | Colby | 279/20 |
| 4,111,468 | A * | 9/1978 | Schneider | 285/190 |
| 4,854,394 | A * | 8/1989 | Heinonen | 173/105 |
| 5,934,394 | A * | 8/1999 | Fareham | 175/292 |
| 6,109,620 | A | 8/2000 | Roberts et al. | |
| 6,273,199 | B1 | 8/2001 | Kiikka et al. | |

FOREIGN PATENT DOCUMENTS

| | | |
|---|---|---|
| EP | 1077305 A1 | 2/2001 |
| WO | 2004/079152 A1 | 9/2004 |

* cited by examiner

*Primary Examiner* — David J Bagnell
*Assistant Examiner* — Richard Alker
(74) *Attorney, Agent, or Firm* — Workman Nydegger

(57) ABSTRACT

An external water delivery system includes a water box front head, a collet configured to interface with the water box front head, a polymer sleeve configured to be positioned between the water box front head and the collet, a shank, and at least one seal positioned within the sleeve. The sleeve and seals are configured to provide a water chamber when coupled to the shank. An inner of the sleeve provides a bearing surface for the shank.

20 Claims, 3 Drawing Sheets

EXTERNAL WATER DELIVERY SYSTEM FOR ROCK DRILLS

RELATED APPLICATIONS

This application claims the benefit of U.S. Provisional Application Ser. No. 61/094,579 filed Sep. 5, 2008 and entitled "External Water Delivery Systems for Rock Drills," the entire disclosure of which is hereby incorporated by reference in its entirety.

BACKGROUND OF THE INVENTION

1. The Field of the Invention

The present invention relates to drilling equipment and to rock drilling equipment in particular.

2. The Relevant Technology

Many drilling processes are currently known and used. One type of drilling process, referred to as rock drilling, includes fracturing small pieces of rock with a bit to form holes. If desired, explosives can also be placed in the holes and used to break and fracture the rock further. One type of drill used in rock drilling is commonly known as a "drifter."

Drifters often include a drifter front end that houses a shank. The shank is coupled on one end to one or more motors that apply rotational and/or percussive forces. A drill rod is coupled to the other end of the shank. Accordingly, percussive and/or rotational forces generated by the motors are transmitted from the shank to the drill rod and from the drill rod to a drill bit. As introduced, the percussive and/or rotational forces transmitted to the bit and applied to the formation act to break and fracture the formation. The broken or fractured particles are then moved from the bit by a fluid delivered to the bit, such as air or liquids.

For example, the shank often includes a channel defined therein that allows liquid to travel from the shank, through the drill rod, through the bit, and to formation to remove the particles. In some examples, the channel is formed in only part of the shank. A water delivery mechanism introduces the water to the channel. The water delivery mechanism often includes a large number of parts, including components to provide a water chamber, seals to seal the water chamber, and bearings to guide and support the shank as the shank rotates within the water delivery mechanism. While such a configuration can reduce the number of components through which the water travels, the large number of separate components, each with separate tolerances, can result in a water delivery mechanism that is difficult to align, maintain, and/or replace.

The subject matter claimed herein is not limited to embodiments that solve any disadvantages or that operate only in environments such as those described above. Rather, this background is only provided to illustrate one exemplary technology area where some embodiments described herein may be practiced.

SUMMARY OF THE INVENTION

An external water delivery system includes a water box front head, a collet configured to interface with the water box front head, a fiber-filled sleeve configured to be positioned between the water box front head and the collet, a shank, and at least one seal positioned within the sleeve. The sleeve and seals are configured to provide a water chamber when coupled to the shank. The inner surface of the sleeve provides a bearing surface for the shank.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

Figure 1:
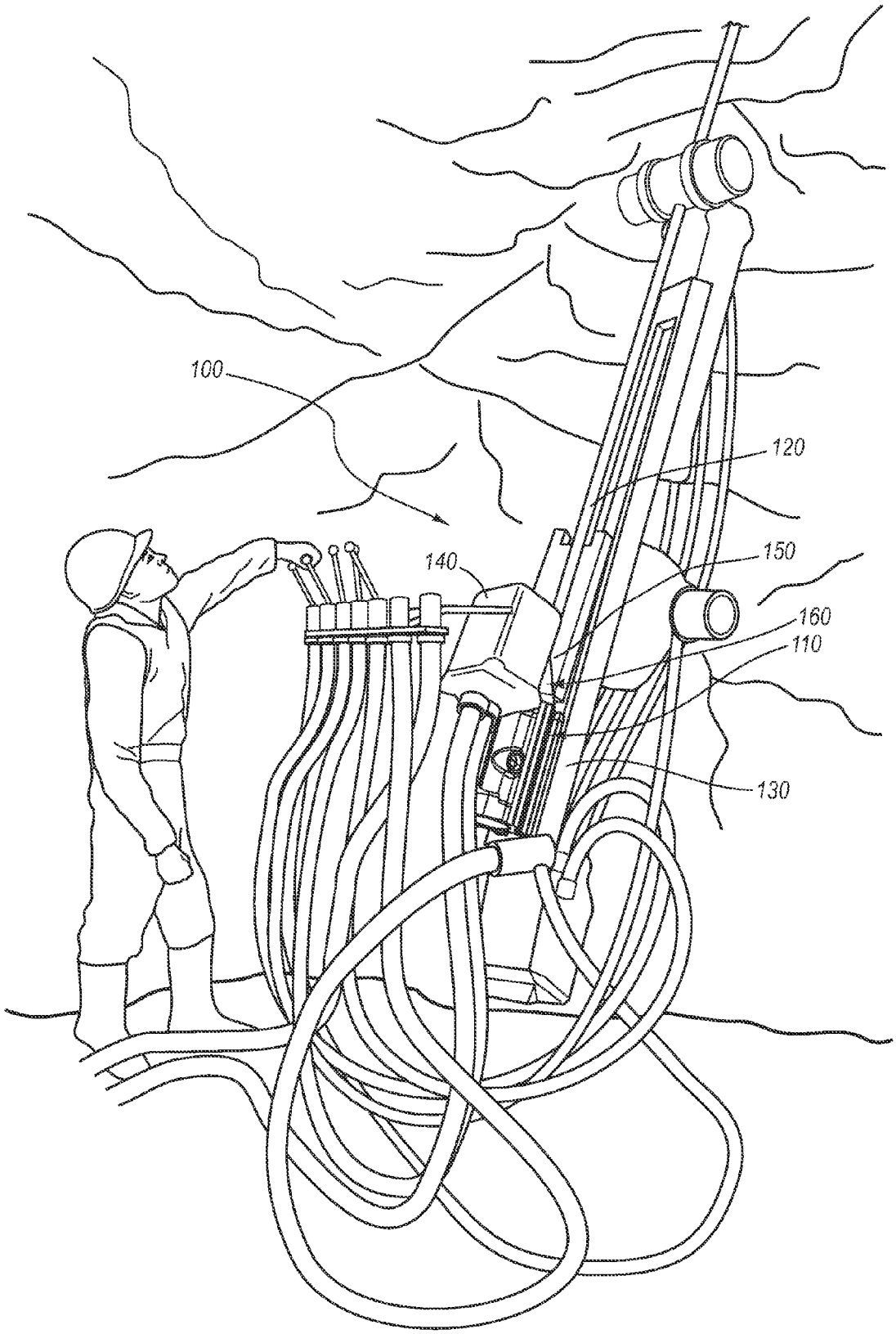
FIG. 1 illustrates a drilling system according to one example.

Together with the following description, the figures demonstrate non-limiting features of exemplary devices and methods. The thickness and configuration of components can be exaggerated in the figures for clarity. The same reference numerals in different drawings represent similar, though not necessarily identical, elements.

DETAILED DESCRIPTION OF THE PREFERRED EMBODIMENTS

An external water delivery system is discussed herein for delivering liquid to a rock drill. In at least one example, the external water delivery system includes a sleeve that is configured to provide both bearing functionality as well as to be sealed to form a water chamber. Such a configuration can reduce the part count associated with delivering water to a shank. Reducing the part count can reduce the tolerance stack of the components and thereby reduce slop and/or increase the accuracy of the alignment of the shank and associated components. Reducing slop can reduce premature wear of the shank as well as the external water delivery system. Further, the configuration of the external water delivery system can allow an operator to quickly replace the shank and/or components of the external water delivery system.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on drifter cylinders in pneumatic drifter rock drill operations, the apparatus and associated methods could be equally applied to other processes such as hydraulic drifter rock drilling, various percussive drilling processes, and the like.

FIG. 1 illustrates a drilling system 100 according to one example. As illustrated in FIG. 1, the drilling system 100 includes a drifter cylinder 110, a drill rod 120, a slide frame, 130, a drive mechanism 140, and a shank 150. The drilling system 100 may be used for drilling holes into rock formations or other hard formations in the earth. The holes may then be used to create fractures in the rock formation with explosives or with other means to allow removal of the fractured rock.

As shown in FIG. 1, the drifter cylinder 110 rests on the slide frame 130. The drive mechanism 140 can include one or more motors configured to rotate the shank 150 within the drifter cylinder 110 and/or transmit a percussive motion to the shank 150. In at least one example, the rotational and/or percussive forces can be applied to the shank 150 as the shank 150 rotates relative to the drifter cylinder 110. The rotational and/or percussive forces applied to the shank 150 are transmitted to the drill rod 120 and in turn to an associated drill bit.

An external water delivery system 160 is also coupled to the water box front head 220 and is configured to deliver water to the shank 150. The shank 150 in turn is in fluid communication with the drill rod 120 which is in fluid communication with a drill bit. Accordingly, the external water delivery system is configured to deliver water or other fluids through the shank 150 to the drill bit. One exemplary external water delivery system will now be described in more detail below.

Figure 2A:
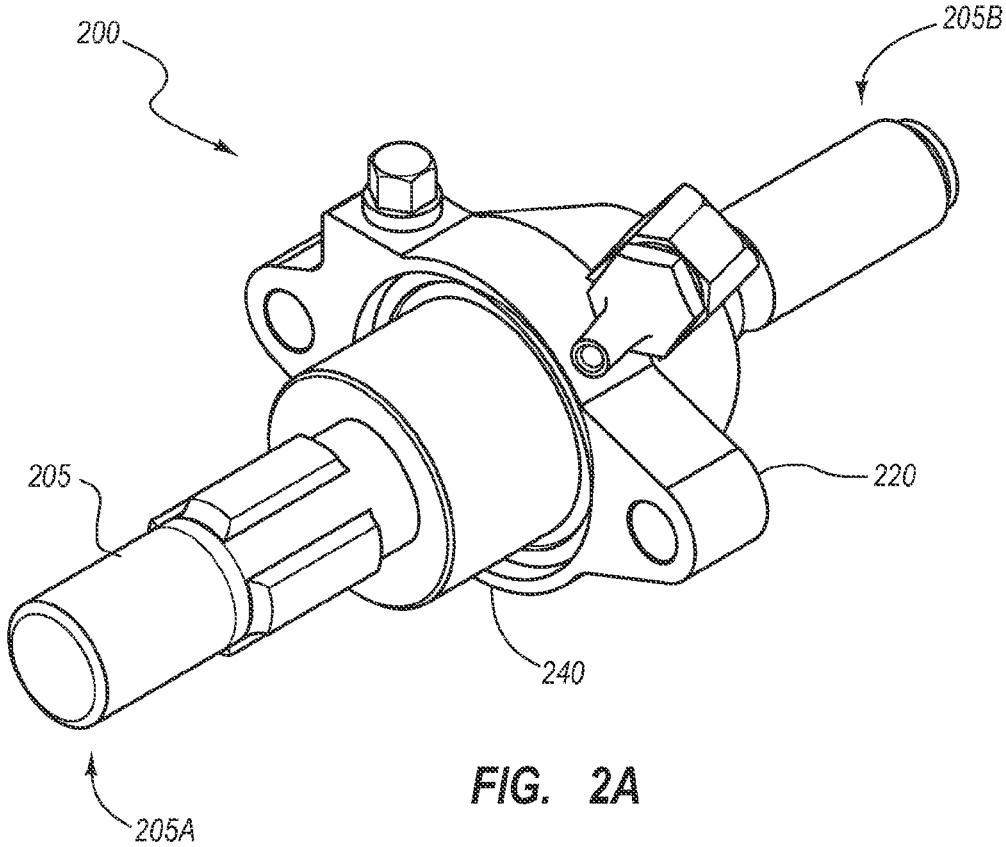
FIG. 2A illustrates a perspective view of an external water delivery system according to one example.

FIG. 2A illustrates a perspective view of an external water delivery system 200 according to one example. The external water delivery system 200 is configured to deliver water through a shank 205. The shank 205 can include a first end 205A configured to have rotary and/or percussive forces applied thereto. The shank 205 can also include a second end 205B, opposite the first end 205A. In at least one example, the second end 205B extends through the external water delivery system 200.

Figure 2B:
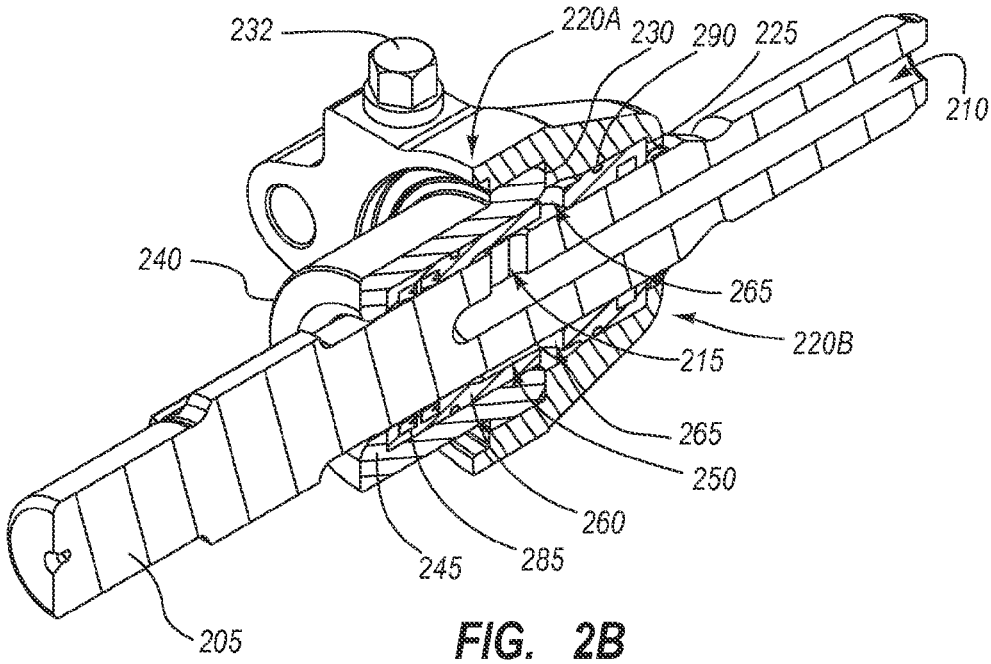
FIG. 2B illustrates a cross sectional view of the external water delivery system of FIG. 2A.
Figure 2C:
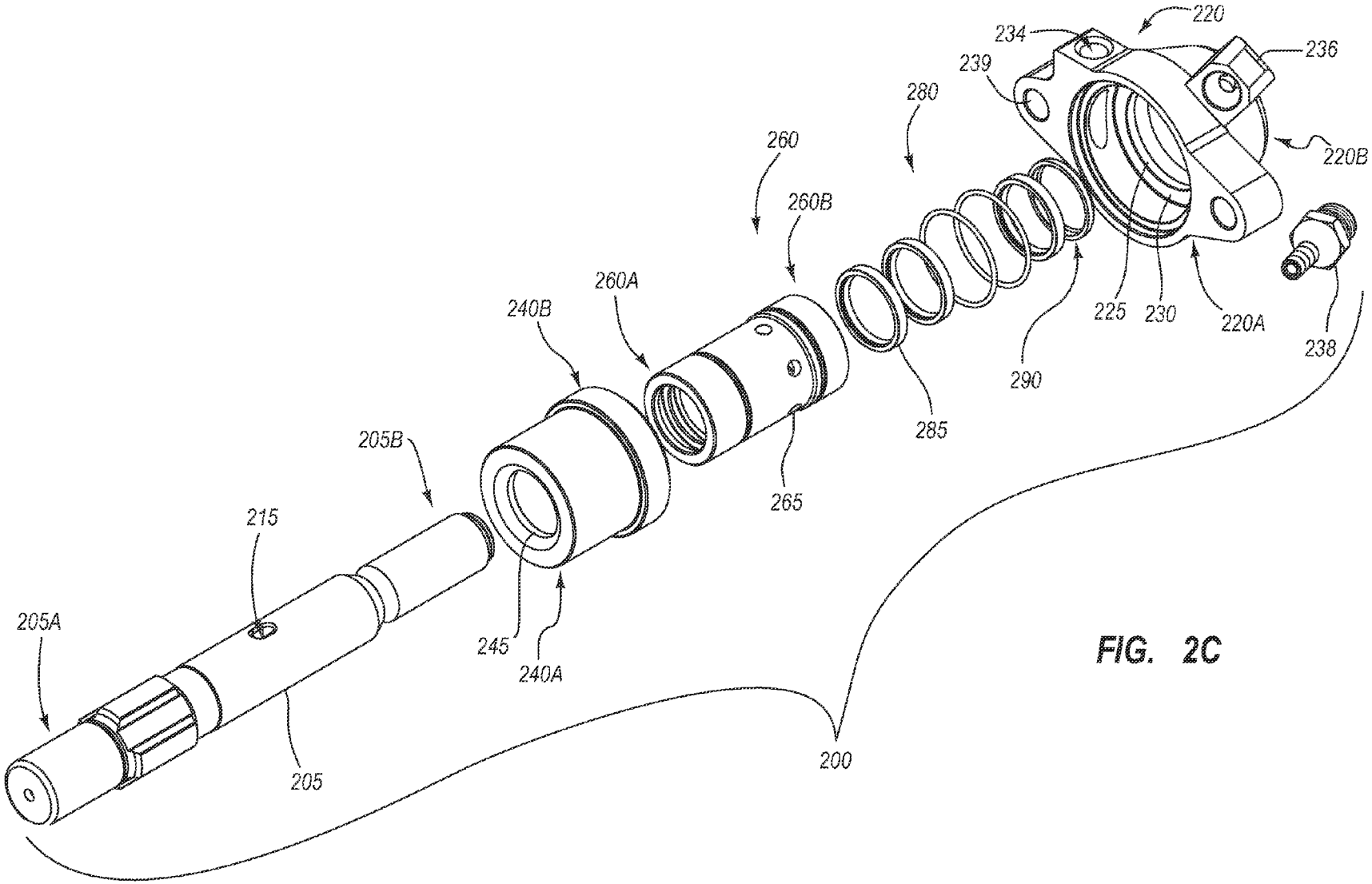
FIG. 2C illustrates an exploded view of the external water delivery system of FIG. 2A.

The external water delivery system 200 further includes a water box front head 220 and a collet 240. FIG. 2B illustrates a sectioned view of the external water delivery system 200. As illustrated in FIG. 2C, the external water delivery system 200 also includes a polymer sleeve 260 and seals, collectively referred to as seals 280. FIG. 2C illustrates an exploded view of the external water delivery system 200.

As illustrated in FIG. 2C, a polymer sleeve 260 is configured to be positioned between the water box front head 220 and the collet 240 to form an integrated water chamber 250 in FIG. 2B that conveys water or other liquid from the front head 220 to the shank 205 as the shank rotates 205 relative to the water box front head 220.

In particular, a channel 210 can be defined in a portion of the shank 205 that extends from the second end 205B toward the first end 205A. A shank port 215 can be defined in a perimeter of the shank 205. The shank port 215 can be in fluid communication with the channel 210. The shank port receives water or other liquids from the water delivery port and directs this water to the channel and toward the second end of the shank.

The sleeve 260 includes a first end 260A and a second end 260B. Further, the sleeve 260 can be formed of a material having characteristics that allow the inner and/or outer surfaces to function as bearing surfaces while being sufficiently durable and heat resistant for use in rock drilling applications. Suitable materials can include, without limitation, reinforced composite material, such as particle-filled nylons including glass-filled nylon. In the illustrated example, the inner surface of the sleeve 260 can include recesses or channels defined therein that are sized to seat one or more of seals. In particular, inner seals 285 can be positioned on the interior of the sleeve 260 between the first end 260A and the second end 260B. Additional seals, such as wiper seals 290, can be seated on an exterior surface of the sleeve 260.

When the external water delivery system 200 is assembled, the sleeve 260 is positioned between a second end of the water box front head 220B and a first end 240A of the collet 240. In particular, a first end of the sleeve 260A is configured to be received within and supported by the collet 240 while a second end 260B is configured to be received within and supported by the water box front head 220. More specifically, the collet 240 can include a first end 240A and a second end 240B. A collet-sleeve shoulder 245 can be located near the first end 240A of the collet 240. The collet-sleeve shoulder 245 can be configured to support the first end 260A of the sleeve 260. Accordingly, the first end 260A of the sleeve 260 can be positioned against the collet sleeve shoulder 245.

In the illustrated example, the water box front head 220 can include a front sleeve shoulder 225 formed near a second end 220B of the water box front head 200 and a collet shoulder 230 formed toward the first end 220A. The front sleeve shoulder 225 can be configured to support the second end 260B of the sleeve 260. Accordingly, the second end 260B of the sleeve 260 can be positioned against the front sleeve shoulder 225.

In order to position the second end 260A of the sleeve 260 against the front sleeve shoulder 225 and the first end 260A of the sleeve 260 against the collet-sleeve shoulder 245, the second end 240B of the collet 240 can be positioned against the collet shoulder 230 of the water box front head 220. Accordingly, when the collet 240 is positioned against the water box front head 220, the sleeve 260 is positioned between the collet 240 and the water box front head 220. The collet 240 can be secured in position relative to the water box front head 220 by a fastener. For example, a cotter pin 232 (FIG. 2B) can be pushed through a hole 234 (FIG. 2C) in the water box front head 220 and into engagement with the collet 240.

With the sleeve 260 positioned between the collet 240 and the water box front head 220, the second end 205B of the shank 205 can be advanced through the collet 240, the sleeve 260, and the water box front head 220 until the shank port 215 is positioned as shown in FIG. 2B. Alternatively, the seals 285, 290 can be positioned on the sleeve 260 and/or the sleeve 260 and/or the collet 240 can be positioned relative to the shank 205 and then the shank, sleeve 260 and/or collet 240 can be positioned relative to the water box front head 220. In any case, with the shank 205 thus positioned within the sleeve 220, the inner seals 285 form a water chamber between the exterior of the shank 205 and the interior of the sleeve 260. The wiper seals 290 on the exterior of the sleeve 260 can help seal the sleeve relative to the collet 240 and the water box front head 220.

Sleeve ports 265 can be defined in the sleeve 260 that are in communication with the water chamber. The sleeve ports 265 can be in fluid communication with an inlet 236 defined in the water box front head 220, which in turn can be in fluid communication with a nozzle 238. The nozzle 238 can be coupled to a water source. Water from the nozzle 238 is thus directed through the inlet 236 in the water box front head 220, through the sleeve ports 265 and into the water chamber 250. From the water chamber 250, the water is then directed to the shank port 215, from the shank port 215 to the channel 210, and from the channel 210 toward the second end 205B of the shank 205. Accordingly, the water delivery assembly 200 is configured to direct water from a water source to the channel 210. As shown in FIG. 2B, the sleeve ports 265 can be offset from the shank port 215.

In the illustrated example, the water box front head 220 is configured to be coupled to a drifter cylinder 110 (FIG. 1). In particular, the water box front head 220 can include mount flanges 239 or other structure that allows a fastener to secure the water box front head to a drifter cylinder 110 (FIG. 1). With the shank 205 thus secured to the water box front head 220 and the front head 220 secured to the drifter cylinder 110, the shank 205 can be rotated and/or a percussive force can be applied to the shank 205 while water or other liquid is directed through the second end 205B of the shank 205.

As the shank 205 rotates, the sleeve 260 can rotate less or be stationary relative to the shank 205 such that as the shank 205 rotates, an inner surface of the sleeve 260 provides a bearing surface relative to the shank 205.

Accordingly, the external water delivery system 200 includes a sleeve 260 that is configured to provide both bearing functionality as well as to be sealed to form the water chamber 250. Such a configuration can reduce the part count associated with delivering water to a shank. Reducing the part count can reduce the tolerance stack of the components and thereby reduce slop and/or increase the accuracy of the alignment of the shank 205 and associated components. Reducing slop can reduce premature wear of the shank 205 as well as the external water delivery system 200. Further, the configuration of the external water delivery system can allow an operator to quickly replace the shank and/or components of the external water delivery system.

In particular, the external water delivery system 200 can be assembled by initially seating the inner seals 285 and the wiper seals 290 on the sleeve 260. The sleeve 260 can then be positioned relative to the water box front head 220. The collet 240 can then be moved into position relative to the water box front head 220. As the collet 240 is moved into position relative to the water box front head 205, the sleeve 260 is also seated relative to the collet 240. The cotter pin 232 can then be used to secure the collet 240 in position relative to the water box front head 205. With the external water delivery system 200 assembled, the shank 205 can then be coupled thereto and/or the external water delivery system can be coupled to a drifter cylinder 110.

The drilling system 100 (FIG. 1) can then be operated as desired. At some point, it may be desirable to replace the shank 205, the sleeve 260, or other components. At that point, the water box front head 220 can be decoupled from the drifter cylinder 110 (FIG. 1) and the collet 240 can be decoupled from the water box front head 220 by removing the cotter pin 232. The worn component or components can then be removed and replaced and the rock drill reassembled. As discussed, such a configuration call allow for ready exchange of the parts, which can reduce cost associated with down time. Similarly, the configuration can reduce the part count and tolerance stack, which can prolong the wear of the components.

Various fasteners and configurations have been described above. It will be appreciated that rock drills and external water delivery systems can have different configurations from those discussed above without departing from the scope of the disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An external water delivery system, comprising:
a water box front head;
a collet configured to interface with the water box front head;
a shank;
a polymer sleeve adapted to be positioned between the shank and one or more of the water box front head and the collet; and
at least one seal positioned at least partially within the sleeve,
wherein the sleeve and the at least one seal is configured to provide a water chamber directly between the sleeve and the shank, and wherein an inner surface of the sleeve provides a bearing surface for the shank as the shank rotates relative to the sleeve.

2. The system of claim 1, further comprising at least one recess defined in an inner surface of the polymer sleeve, the at least one seal being seated at least partially within the at least one recess of the sleeve.

3. The system of claim 2, further comprising at least one wiper seal positioned between the sleeve and the waterbox front head.

4. The system of claim 1, wherein:
the collet includes a first end and a second end;
a collet-sleeve shoulder is formed near the first end, the collet-sleeve shoulder being configured to retain the sleeve within the collet; and
the water box front head includes a front sleeve shoulder formed thereon, the front sleeve shoulder being configured to retain the sleeve in the water box front head.

5. The system of claim 4, wherein the water box front head includes a collet shoulder formed thereon.

6. The system of claim 5, wherein the collet shoulder is formed toward a first end of the water box front head, and the front sleeve shoulder is formed toward a second end of the water box front head.

7. The system of claim 5, wherein an opening is defined in the water box front head, the opening being configured to receive a fastener, the fastener being configured to engage the collet sleeve shoulder to retain the collet in engagement with the water box front head.

8. The system of claim 1, wherein the water chamber extends longitudinally along the shank.

9. An external water delivery system, comprising:
a water box front head having an inlet;
a collet configured to interface with the water box front head;
a shank having a first end and a second end, a port inlet defined between the first end and the second end, and a channel defined in the second end and extending into fluid communication with the port inlet;
a sleeve positioned directly about the shank; and
at least one seal positioned at least partially within the sleeve, wherein the sleeve and the at least one seal is configured to provide a water chamber between the shank and the sleeve, whereby, the water chamber maintains fluid communication between with the inlet and the port inlet as the shank rotates relative to the sleeve.

10. The external water delivery system of claim 9, further comprising a locking pin configured to removably couple the collet to the water box front head.

11. The external water delivery system of claim 9, wherein an inner surface of the sleeve provides a bearing surface for the shank.

12. The external water delivery system of claim 9, wherein a first end of the sleeve is positioned directly between the shank and the collet.

13. The external water delivery system of claim 12, wherein a second end of the sleeve is positioned directly between the shank and the water box front head.

14. A rock drilling system, comprising:
a drifter cylinder;
a shank operatively associated with the drifter cylinder, the shank having a first end and a second end, a port inlet defined between the first end and the second end, and a channel defined in the second end and extending into fluid communication with the port inlet; and
an external water delivery system coupled to the drifter cylinder; the external water delivery system including:

a water box front head having an inlet, a collet configured to interface with the water box front head, a reinforced-polymer sleeve configured to be positioned between the shank and one or more of the water box front head and the collet, the sleeve including at least one sleeve port that is offset from the port inlet, and at least one seal positioned at least partially within the sleeve, wherein the sleeve and the at least one seal is configured to provide a water chamber between the shank and the sleeve, the water chamber being in fluid communication with the inlet, the at least one sleeve port, and the port inlet.

15. The system of claim 14, further comprising a locking pin configured to removably couple the collet to the water box front head.

16. The system of claim 14, wherein an inner surface of the sleeve provides a bearing surface for the shank.

17. The system of claim 14, wherein the sleeve comprises a plurality of sleeve ports that each offset from the port inlet.

18. The system of claim 14, wherein the water chamber extends longitudinally along the shank.

19. The system of claim 18, wherein the at least one sleeve port is longitudinally offset from the port inlet.

20. The system of claim 14, wherein the shank is adapted to rotate relative to the sleeve.

* * * * *